US007567177B2

(12) United States Patent
Ben-David

(10) Patent No.: US 7,567,177 B2
(45) Date of Patent: Jul. 28, 2009

(54) SYSTEM AND METHOD FOR ARTICLE AND PROXIMITY LOCATION

(75) Inventor: Yoav Ben-David, 2/32 Stimatzky Street, Tel Aviv (IL) 69369

(73) Assignees: Yoav Ben-David, Tel-Aviv (IL); Histour-Eltiv Ltd, Tel Aviv (IL)

( * ) Notice: Subject to any disclaimer, the term of this patent is extended or adjusted under 35 U.S.C. 154(b) by 328 days.

(21) Appl. No.: 11/559,901

(22) Filed: Nov. 15, 2006

(65) Prior Publication Data

US 2007/0115117 A1 May 24, 2007

Related U.S. Application Data

(60) Provisional application No. 60/739,025, filed on Nov. 23, 2005.

(51) Int. Cl.
*G08B 13/14* (2006.01)

(52) U.S. Cl. ..... 340/568.7; 340/539.13; 340/539.32

(58) Field of Classification Search ... 340/568.1–568.7, 340/539.11–539.32
See application file for complete search history.

(56) References Cited

U.S. PATENT DOCUMENTS

| | | | | |
|---|---|---|---|---|
| 6,522,253 | B1 * | 2/2003 | Saltus | 340/571 |
| 6,724,306 | B1 * | 4/2004 | Parsley et al. | 340/568.1 |
| 2002/0014955 | A1 * | 2/2002 | Klitsgaard | 340/10.42 |
| 2003/0132842 | A1 * | 7/2003 | Chia-Yen | 340/568.1 |
| 2004/0075554 | A1 * | 4/2004 | Yang | 340/539.32 |
| 2004/0246129 | A1 * | 12/2004 | Goggin | 340/539.23 |
| 2004/0252030 | A1 * | 12/2004 | Trimble et al. | 340/825.36 |

* cited by examiner

*Primary Examiner*—Brent Swarthout
(74) *Attorney, Agent, or Firm*—Pearl Cohen Zedek Latzer, LLP

(57) ABSTRACT

A system and method which enable an airline passenger who is traveling with articles, such as baggage and the like, to easily locate them upon arrival to the airport luggage retrieval point, even among a mass of look-alike baggage articles around it. The system is activated automatically by a light and/or acoustic sensors, is easy to use, easy to install and inexpensive. The system is also capable of providing the user with an indication whether his baggage is getting closer to him or moving farther away from him.

18 Claims, 5 Drawing Sheets

SYSTEM AND METHOD FOR ARTICLE AND PROXIMITY LOCATION

CROSS-REFERENCE TO RELATED APPLICATIONS

This application claims the benefit under 35 USC 119(e) from U.S. provisional application 60/739,025 filed Nov. 23, 2005, the disclosure of which is included herein by reference.

FIELD OF THE INVENTION

The present invention relates to a system especially for airline passengers who is traveling with articles, such as baggage and the like, may be separated from the traveler for a long period of time and then reconnected when he arrives at his destination. The passenger can locate his luggage using electronic means such as electronic luggage tags, luggage proximity systems, pagers, messaging devices, transmitters, receivers and transceivers.

BACKGROUND OF THE INVENTION

One of the problems encountered by airline travelers is to locate his baggage upon arriving to his destination. Usually, he will face a moving carousel with a mass of baggage articles, from which he needs to find his own baggage. His luggage may also be mistakenly removed by someone else.

U.S. Pat. No. 6,342,836 given to Zimmerman provides a system for detecting the luggage while in the aircraft as well as at the luggage arrives the retrieval point. The transmitter is activated by a complicated flight profile detector to limit the transmission time. U.S. Pat. No. 6,724,306 given to Parsley et al provides a system that indicates to the traveler when the article is approaching him and when it is getting farther away from him, but it does not activate automatically and the large and bulky transmitter which is positioned inside the luggage to protect it.

SUMMARY OF THE INVENTION

It is the object of the present invention to provide a system which enables an airline passenger who is traveling with articles, such as baggage and the like, to easily locate them at the luggage retrieval point, even among a mass of look-alike baggage articles around it.

An aspect of the present invention to have the transmitter sense if it is situated in a cargo compartment environment, using sensors such as a light intensity sensor, acoustic sensor, altitude sensor and the like. When said sensor is a light intensity level sensor it can also be coupled with a filter.

An aspect of the present invention to provide a system which indicates to the user that his baggage is either getting closer to him or farther away from him. This system can also be used for child monitoring and similar applications.

It is a farther object of the present invention is to provide a system which is automatically activated, easy to use, easy to install and inexpensive.

These and other advantages of the present invention will become apparent upon reading the following detailed descriptions and studying the various figures of the drawings.

BRIEF DESCRIPTION OF THE DRAWINGS

The present invention will become fully understood from the detailed description given herein below and the accompanying drawings, which are given by way of illustration only and thus not limitative of the present invention, and wherein.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided, so that this disclosure will be thorough and complete, and will fully convey the scope of the invention to those skilled in the art.

Unless otherwise defined, all technical and scientific terms used herein have the same meaning as commonly understood by one of ordinary skill in the art to which this invention belongs. The methods and examples provided herein are illustrative only and not intended to be limiting.

Figure 1:
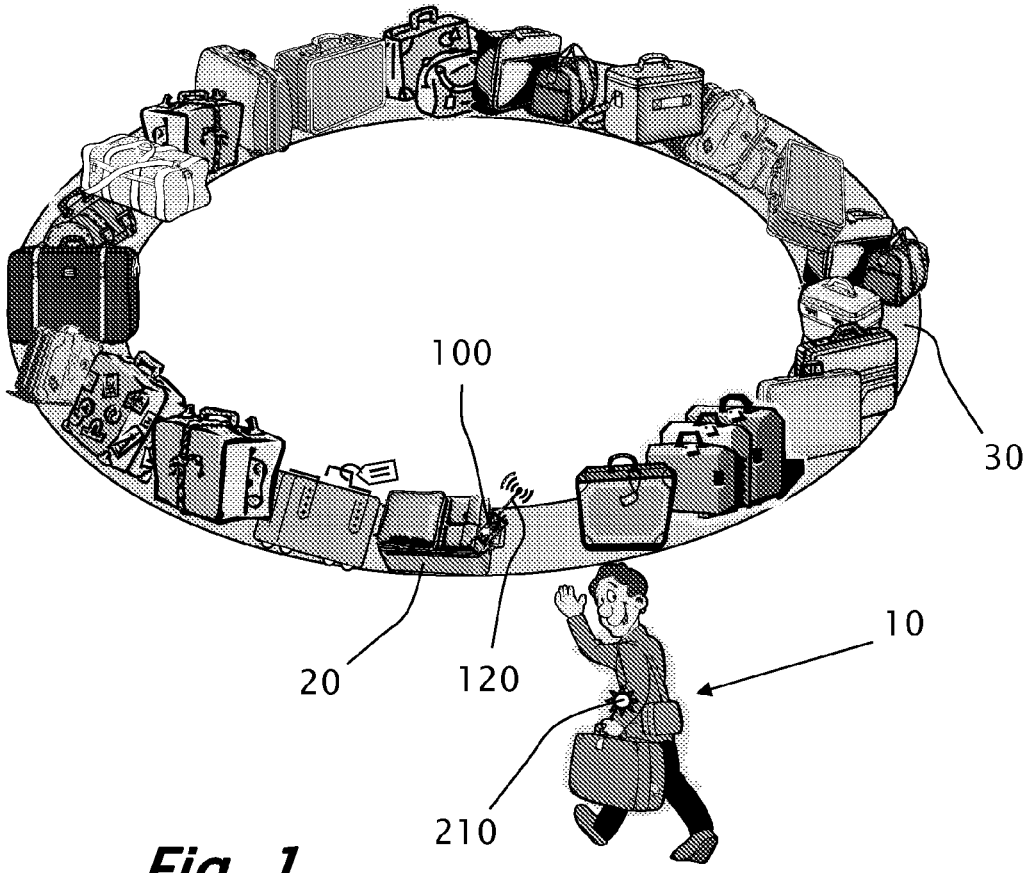
FIG. 1 is a front perspective view of the loaded carousel where the system of the present invention operates.

With reference to FIGS. 1-3 and 6-8, embodiments of the present invention comprises a transmitting unit 100 which is attached to a traveling article such as a suitcase 20. The transmitting unit 100 is activated by light and/or acoustic sensors that sense that the suitcase 20 has emerged from the aircraft. When the light intensity detected is above the preset threshold and/or a change in the acoustic noise level, relative to the steady noise in the aircraft, is detected, and/or altitude is detected, they activate the transmitter 100, which starts sending a coded RF signal via antenna 120. Antenna 120 is shown in FIG. 1 as a long antenna for illustration purposes only, and is preferably embodied as part of the printed circuitry for durability and other reasons. In the case of a light sensor, the threshold is set to detect at least the light level of an airport luggage retrieval point halls level. Optionally, when the transmitter is activated, the indicator led 120 is turned on. Optionally, said light sensor can be coupled with a filter. In the cargo compartment of the aircraft lights might be turned on, for example, yellow lights. Coupling the light sensor with a blue filter, for example, can block this light from the sensor and thus still detect it as being inside the cargo compartment of the aircraft.

Other sensors, such as an altitude sensor or any other sensor known in the art, can also be used to detect the luggage location Transmission is roughly limited in distance to the length of an airport carousel, which is about 10 meters. The RF frequency used is in the range of 400-500 MHz, designated for common electronic devices, and is safe to use in airports as well. The preferred embodiment of this invention utilizes a basic frequency of 433 MHz, which is given her by way of example, not limitation. Another possible range is 900-950

MHz or any other range. Typically, transmission will be at a low power and below allowed levels.

The transmitter can be 64 bits deep which enables $2^{64}$ possible code IDs. This assures that practically, all code IDs will be unique.

Optionally, the transmitter can change the time of transmission, the time interval between transmissions and the code ID according to the country or region where it is situated. This can be preset manually by the user or change automatically by detecting the transmission frequencies used in said location.

In a credit card size transmitter, a battery can prevail about 24 hours of continuous operation. In a larger housing, using AAA batteries, it can last a week of continuous operation. This information is given here by way of example, not limitation, and any type of battery or batteries can be used.

The receiving unit 200 is powered on by a user 10. When detecting and identifying the transmitted code, it turns on one or more indicators such as visual indicators, and/or audio indicators and/or vibrating indicator, to indicate to user 10 that his baggage is arriving or has arrived.

Referring now to FIG. 1, a view of the loaded carousel 30, where the system of the present invention operates, is given. The carousel 30 is loaded by a wide variety of baggage articles, many of which look alike. Transmitter 100 has been active since the light and/or noise detectors have activated it. Transmitter 100 transmits its ID code at a preset time interval, for example: every 20 milliseconds. The optional light indicator 120 has been turned on at activation time.

The user/traveler 10 has turned on the receiving unit, and when it detects and identifies the signal emitted from the transmitting unit 100, designated indicators advise the user 10 that his luggage is arriving. These indicators can be one or any combination of a light, sound and a vibrator. As transmitter 100 gets closer to user 10, the indication gets stronger as well and if the transmitter 100 gets farther away from user 10, the indication gets weaker. The light may change in intensity and/or flicker at a changing frequency.

The transmitting unit 100 can also serve as a luggage tag, and can be made of a durable plastic material which is also strong and flexible, and onto which the electronic circuitry can be printed. Such materials are now widely used in the industry, for example, Glass Epoxy.

Figure 2:
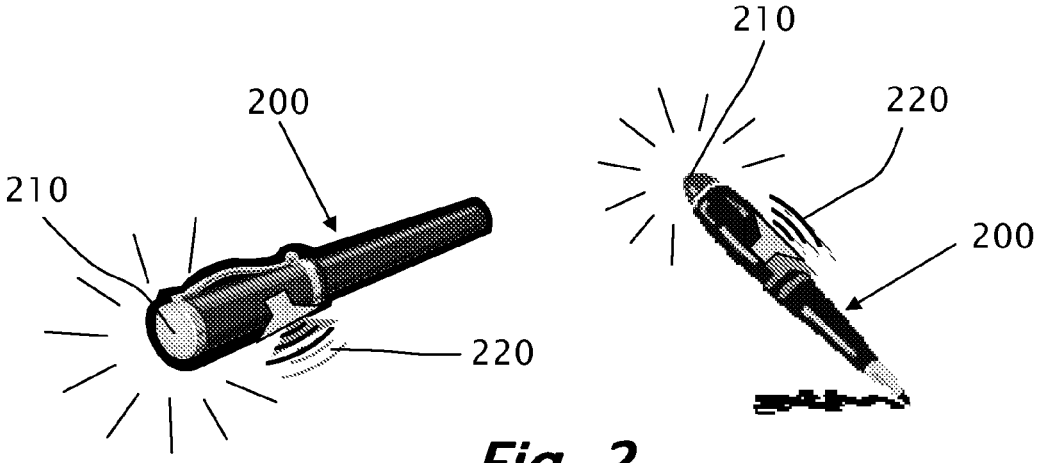
FIG. 2 shows a pen embodiment of the receiver unit of the present embodiment.

Referring now to FIG. 2, one embodiment of a receiving unit 200 is described. In this embodiment the receiver is integrated into a pen like housing. It may also serve as a pen. It can have an audio speaker 220 built into it. Another option is a light source 210 such as a led built into it. This light can be optionally used by the user as a flash light. It can also have a vibrator built into it. As described before, the light and/or sound and/or vibration will be turned on when it identifies the received code ID. It will get stronger as transmitter 100 gets closer to user 10, and will get weaker as transmitter 100 gets farther away from user 10.

Figure 3:
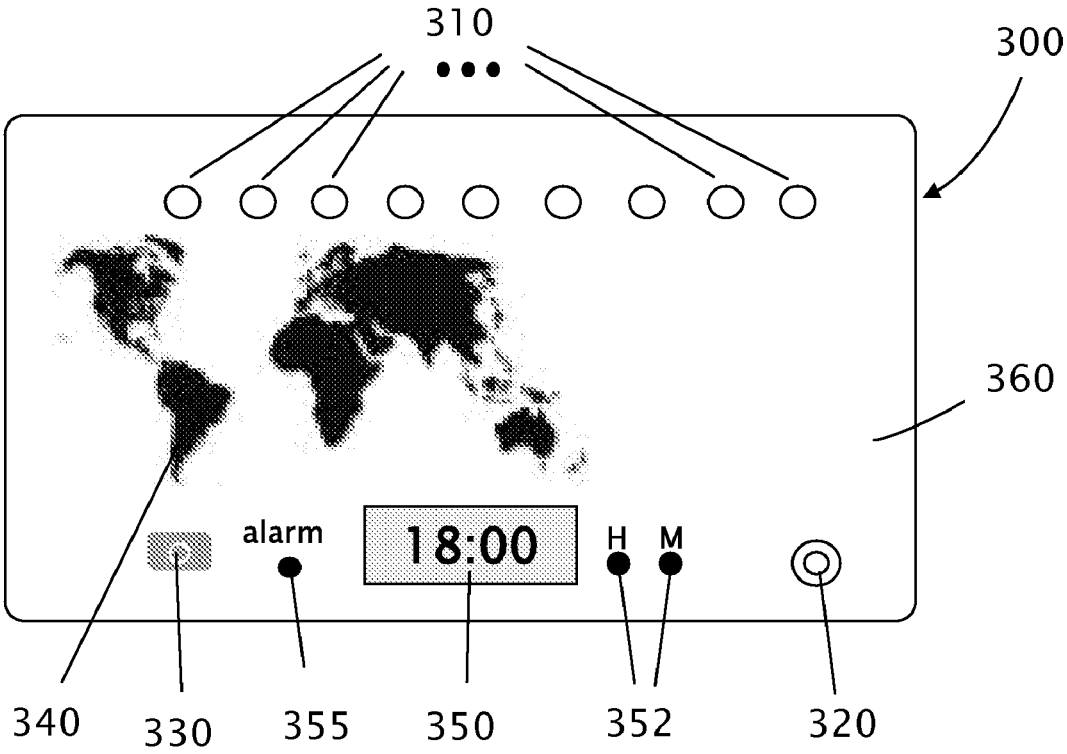
FIG. 3 shows a credit card like embodiment of the receiver of the present embodiment.

Referring to FIG. 3, another embodiment of a receiving unit 300 is described. In this embodiment the receiver is integrated into a credit card like housing. It is activated by user 10 pushing upon button 330. It can have an audio speaker 320 built into it. Another option is a light source 320 such as a led built into it. This can also be implemented as a group of leds 310. The leds may be of various colors. As transmitter 100 gets closer to user 10 more lights will be turned on, and as transmitter 100 gets farther away from user 10 they will be turned off. One or more leds can be optionally used by the user as a flash light. It can also have a vibrator built into it. As described before, the light and/or sound and/or vibration will get stronger as transmitter 100 gets closer to user 10, and will get weaker as transmitter 100 gets farther away from user 10.

It may as well serve as a clock showing the time at various cities around the globe, for example, by touching the graphical location on the map. The time is shown for example, in a LCD display 350. An alarm clock can also be incorporated and set by buttons 352 and 355. The time can also be set by buttons 352 and 355. Another option is to add a calculator 360 which will also use the LCD display 350.

In another embodiment of the present invention the transmitter/receiver system can be used for child monitoring, except that the proximity indication is the other way around: as the child gets farther away from his supervisor, the indication gets stronger. This can be implemented in the same system by a switch that inverts the indication intensity.

In yet another embodiment of the present invention, if the receiver controls more than one incoming code IDs, it will have an indication as to which article it is detecting at a given time. This can be done by different sounds, extra sets of leds, different color leds and so on and so forth.

Figure 4:
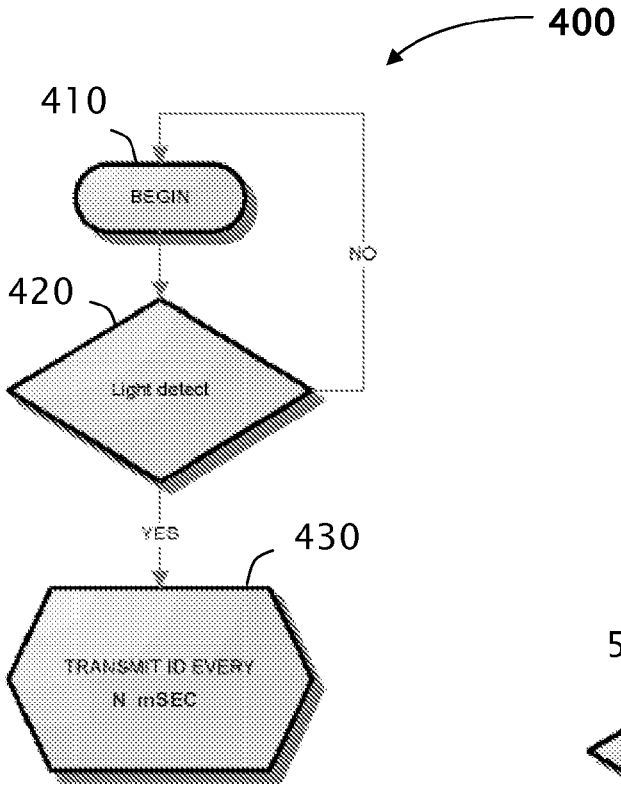
FIG. 4 is a block diagram of the logic behind the transmitter unit of the preferred embodiment of this invention.

Referring now to FIG. 4, a block diagram 400 of the transmitting unit is described. Before the unit is activated the units operates at power saving mode. At this mode only the light and/or acoustic detectors, represented by block 410, draw energy from the battery. If the light detected 420 level is below a preset threshold, and/or no changes detected in the noise level, nothing happens. If the light detected 420 level surpasses the preset threshold and/or changes are detected in the noise level, the transmitting circuitry is activated at block 430. The acoustic noise detector ignores the constant noise levels occurring during the flight inside the cargo compartment of an aircraft. If it detected a change in the noise levels, except for brief changes (that may occur during the flight, such as the folding of the wheels), it activates the transmitter. The transmitter transmits a code ID at a preset time interval, for example, every 20 milliseconds.

This circuitry may also include a time limit which can be optionally preset by the user. This time limit will activate the light and/or noise detectors, only after the preset time is passed.

Figure 5:
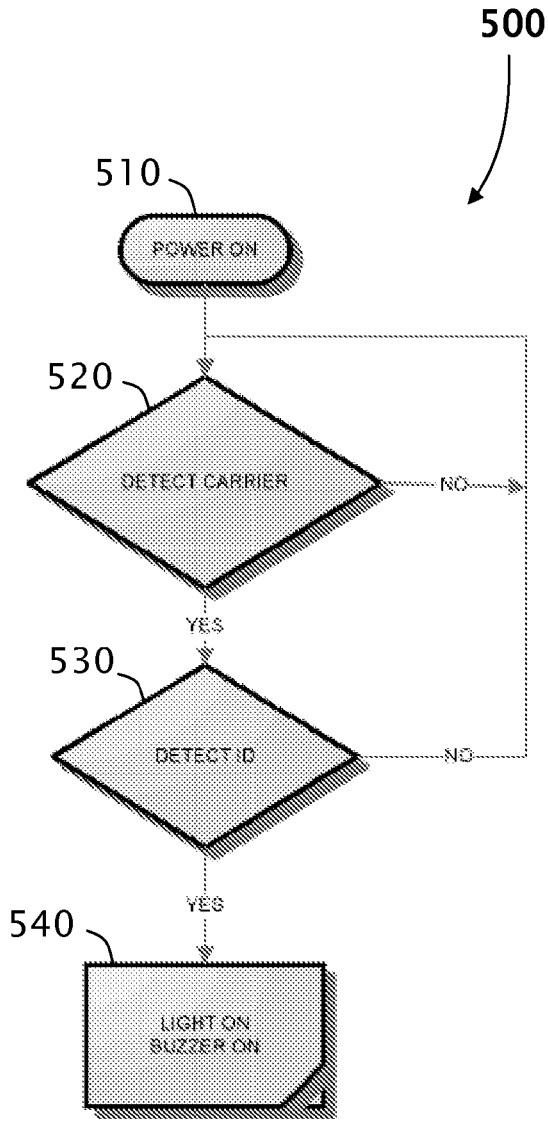
FIG. 5 is a block diagram of the logic behind the receiver unit of the preferred embodiment of this invention.

Referring now to FIG. 5, a block diagram 500 of the receiving unit is described. The unit is activated by the user at block 510. The receiver listens to incoming RF signals at block 520. When it detects such a signal, it tries to identify the transmitted code ID at block 530. If the specific code ID is detected, designated indications are turned on at block 540: light indicators and/or sound indicators and/or vibrating indication. The strength of the indication is directly proportional to the strength of the incoming RF signal.

Figure 6:
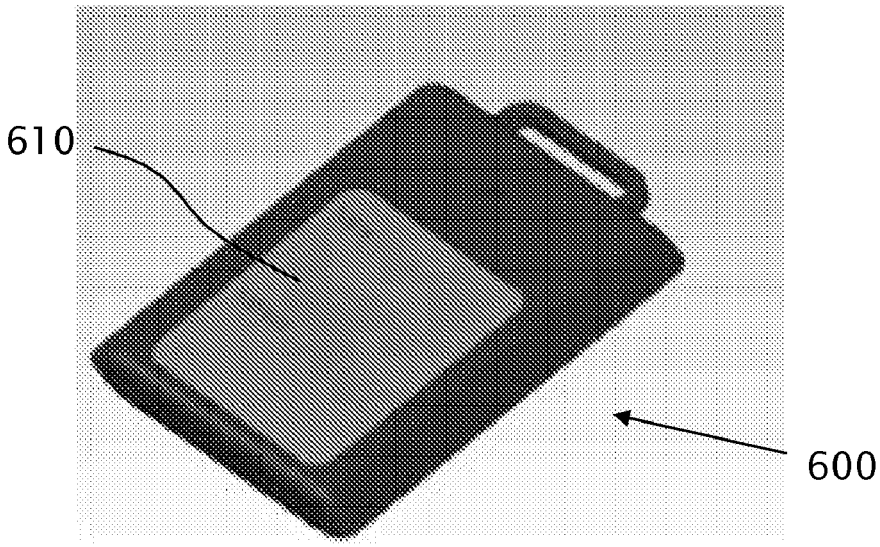
FIG. 6 shows an example of a transmitter of an embodiment according to the present invention.

FIG. 6 shows an example of a transmitter 600 of an embodiment according to the present invention. In this example the transmitter also has a label are 610. Both transmitter 600 and label 610 can each come in assorted colors to ease the identification process.

Figure 7:
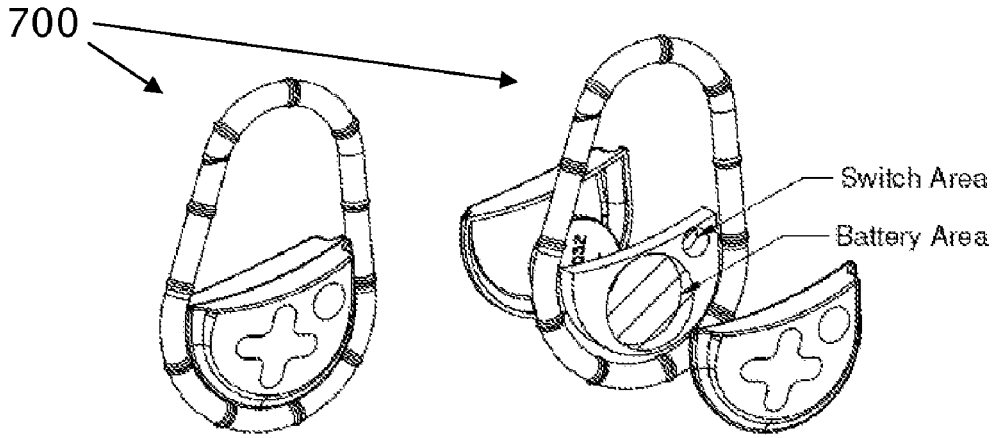
FIG. 7 shows another example receiver of an embodiment according to the present invention, shaped as a key chain.
Figure 7:
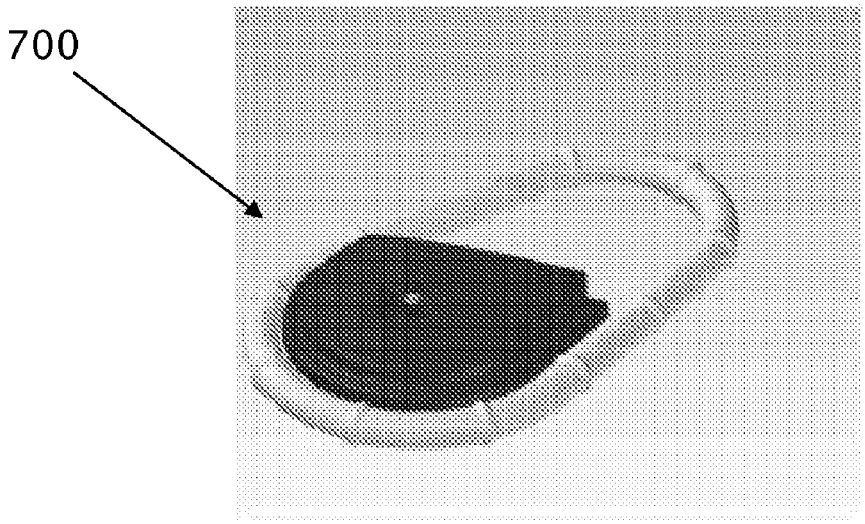

FIG. 7 show another example receiver 700 of an embodiment according to the present invention, shaped as a key chain.

Figure 8:
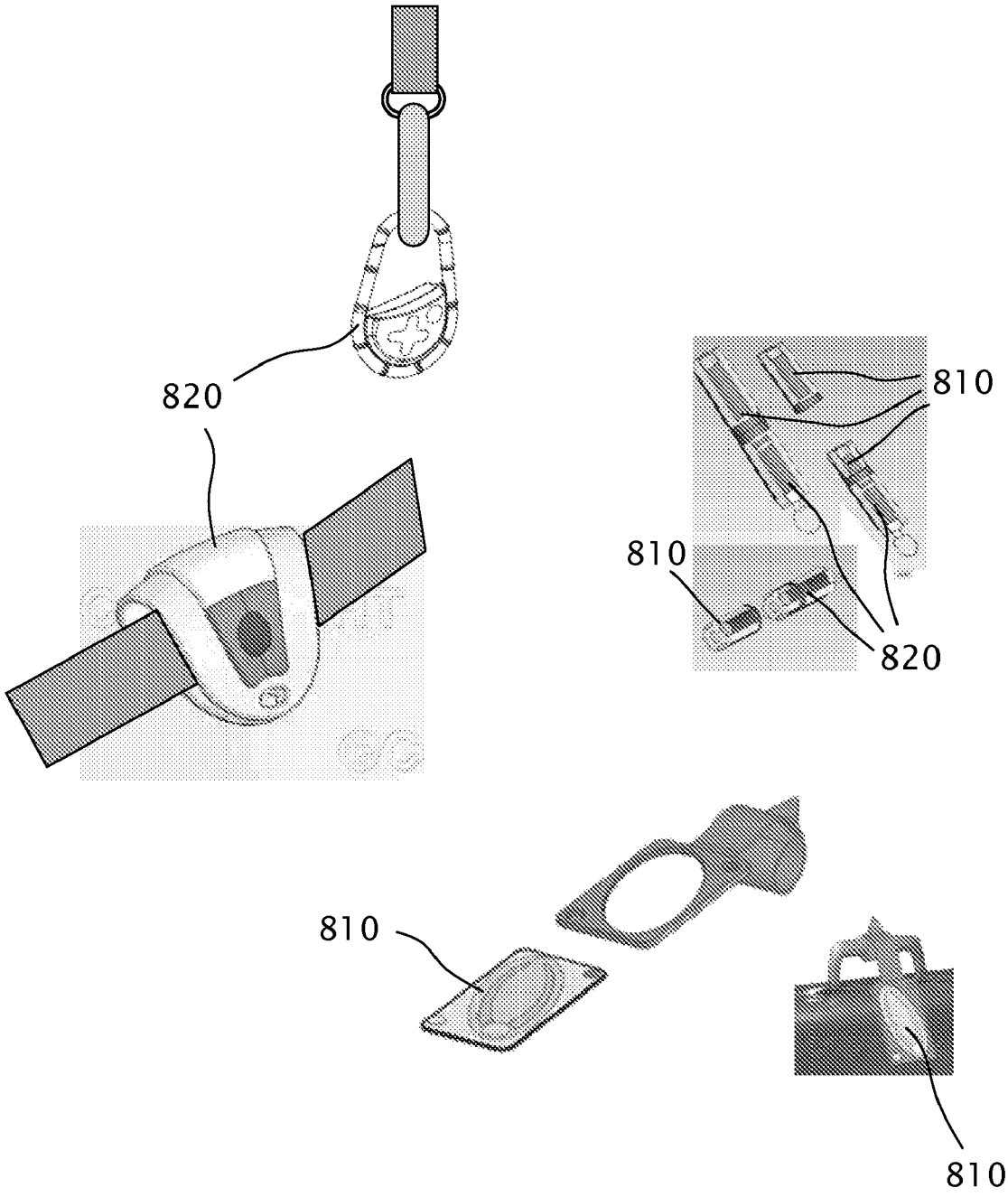
FIG. 8 shows assorted example embodiments of transmitters/receivers according to the present invention.

FIG. 8 show assorted example embodiments of transmitters 810 and receivers 820 according to the present invention.

In yet another embodiment of the present invention, if the receiver is integrated into a cellular phone, whereas the transmitter has the capability to ring a pre-selected phone number, upon the receiver arrival the retrieval point.

In still another embodiment of the present invention, if the receiver is placed on the baggage and the user has the transmitter.

While the present invention has been described in terms of a proximity communication system and structure as well as structures and methods for verifying the proximity and location of baggage, one skilled in the art will realize that the structure and techniques of the present invention can be applied to many similar devices. The present invention may be applied in any situation where proximity, identification and location of objects are needed.

Although the present invention has been described with reference to the preferred embodiment and examples thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the following claims.

What is claimed is:

1. A luggage locating system comprising:

(a) a luggage location unit having a transmitter for transmitting an identifying code and having a housing which is durable;

(b) a sensor that senses cargo compartment environment; and (c) an indicator unit having a receiver for receiving said identifying code and for indicating receipt of said identifying code to indicate a presence of said luggage location unit and thus the unit of luggage itself, wherein said sensor is an acoustic noise sensor that can detect changes in volume or frequency levels.

2. The luggage locating system of claim 1, wherein said receiver is integrated into a cellular phone, and wherein said transmitter has the capability to ring a pre-selected phone number, upon its arrival.

3. The luggage locating system of claim 1, wherein said receiver is programmed to sense the amplitude of the incoming transmitted identifying code and provide a change of the indication which is directly proportional to said amplitude.

4. The luggage locating system of claim 1, wherein said indicator unit is a light indicator-a sound indicator or a vibrating indicator.

5. The luggage locating system of claim 1, wherein said indicator unit is a led.

6. The luggage locating system of claim 1, wherein said indicator unit is LED and also serves as a flash light.

7. The luggage locating system of claim 1, wherein said luggage location unit is a first luggage location unit, and further comprising at least a second luggage location unit said second luggage location unit having an associated transmitter for transmitting an identifying code to said receiver.

8. The luggage locating system of claim 7, wherein said indicator unit includes means to indicate which said luggage location unit is currently in communication with said indicator unit.

9. The luggage locating system of claim 1, wherein said luggage location unit includes an indication that it is active.

10. The luggage locating system of claim 1, wherein said indicator unit is a multifunctional.

11. The luggage locating system of claim 1, wherein said indicator unit is a multifunctional and also comprises a pen.

12. The luggage locating system of claim 1, wherein said indicator unit is a multifunctional and also comprises a radio tuner.

13. The luggage locating system of claim 1, wherein said indicator unit is a multifunctional and also comprises a clock.

14. The luggage locating system of claim 1, wherein said indicator unit is a multifunctional and also comprises an alarm clock.

15. The luggage locating system of claim 1, wherein said indicator unit is a multifunctional and also comprises a clock and means to select time at specific locations on the globe.

16. The luggage locating system of claim 1, wherein said indicator unit is a multifunctional and also comprises a key chain.

17. The luggage locating system of claim 1, wherein said transmitter can change the time of transmission, the time interval between transmissions and the code ID according to the country or region where it is situated, and can be preset manually by the user or changed automatically by detecting the transmission frequencies used in said country or region where it is situated.

18. A luggage locating system comprising:

(a) a luggage location unit having a transmitter for transmitting an identifying code and having a housing which is durable;

(b) a sensor that senses cargo compartment environment; and (c) an indicator unit having a receiver for receiving said identifying code and for indicating receipt of said identifying code to indicate a presence of said luggage location unit and thus the unit of luggage itself wherein said transmitter can change the time of transmission, the time interval between transmissions and the code ID according to the country or region where it is situated, and can be preset manually by the user or changed automatically by detecting the transmission frequencies used in said country or region where it is situated.

* * * * *